US008025536B1

(12) United States Patent
Kelly

(10) Patent No.: US 8,025,536 B1
(45) Date of Patent: Sep. 27, 2011

(54) POLARIZED SHELL FOR PREVENTING COAXIAL CONNECTOR MIS-MATING

(75) Inventor: Mark Kelly, Endicott, NY (US)

(73) Assignee: Distinct Intuitive Designs, LLC, Endicott, NY (US)

( * ) Notice: Subject to any disclaimer, the term of this patent is extended or adjusted under 35 U.S.C. 154(b) by 0 days.

(21) Appl. No.: 12/861,564

(22) Filed: Aug. 23, 2010

(51) Int. Cl.
*H01R 13/64* (2006.01)

(52) U.S. Cl. ..... 439/681

(58) Field of Classification Search ..... 439/681, 439/677, 314, 321, 133, 299
See application file for complete search history.

(56) References Cited

U.S. PATENT DOCUMENTS

| | | | | |
|---|---|---|---|---|
| 3,194,588 | A | 7/1965 | Buckey et al. | |
| 3,551,880 | A | 12/1970 | Hartwell | |
| 3,714,617 | A | 1/1973 | Bright et al. | |
| 3,930,710 | A * | 1/1976 | Sollanek | 439/472 |
| 4,109,990 | A | 8/1978 | Waldron et al. | |
| 4,111,514 | A * | 9/1978 | Brishka et al. | 439/680 |
| 4,229,064 | A * | 10/1980 | Vetter et al. | 439/680 |
| 4,291,933 | A | 9/1981 | Kakaris | |
| 4,457,575 | A | 7/1984 | Davis et al. | |
| 4,500,153 | A | 2/1985 | Mattingly, Jr. et al. | |
| 4,508,407 | A * | 4/1985 | Ball | 439/312 |
| 4,580,868 | A | 4/1986 | Verstijnen | |
| 4,641,811 | A | 2/1987 | Gallusser et al. | |
| 4,736,999 | A | 4/1988 | Marks et al. | |
| 5,145,394 | A | 9/1992 | Hager | |
| 5,267,882 | A | 12/1993 | Davis | |
| 5,395,246 | A | 3/1995 | Punako et al. | |
| 5,641,310 | A | 6/1997 | Tiberio, Jr. | |
| 5,662,488 | A * | 9/1997 | Alden | 439/314 |
| 6,152,753 | A * | 11/2000 | Johnson et al. | 439/321 |
| 6,280,257 | B1 * | 8/2001 | North et al. | 439/680 |
| 6,431,915 | B1 | 8/2002 | Ko | |
| 6,443,778 | B1 | 9/2002 | Koch | |
| 6,666,726 | B2 | 12/2003 | Koch | |
| 6,852,924 | B2 * | 2/2005 | Lessard | 174/50 |
| 6,986,676 | B1 | 1/2006 | Tronolone et al. | |
| 7,221,245 | B2 | 5/2007 | Tanbakuchi et al. | |
| 7,326,091 | B2 * | 2/2008 | Nania et al. | 439/681 |
| 7,722,259 | B2 * | 5/2010 | Smith et al. | 385/53 |
| 7,736,196 | B1 * | 6/2010 | Isaac et al. | 439/680 |
| 2004/0108914 | A1 | 6/2004 | Tanbakuchi et al. | |
| 2005/0140459 | A1 | 6/2005 | Tanbakuchi et al. | |
| 2005/0164562 | A1 | 7/2005 | Lee et al. | |

(Continued)

OTHER PUBLICATIONS

SV Microwave® ZMA Connectors and Components Specification Sheet Catalog No. 300-99-005© 2005-2007 SV Microwave, Inc. (4 pages).

(Continued)

*Primary Examiner* — Chandrika Prasad
(74) *Attorney, Agent, or Firm* — Harris Beach PLLC

(57) ABSTRACT

A polarized shell for preventing mis-mating of a first coaxial connector comprising the polarized shell and a second coaxial connector is provided. In one exemplary embodiment of the invention, the polarized shell can comprise an external wall, and internal wall, and two or more polarizing members circumferentially spaced apart on one of the external wall and the internal wall. A coaxial connector for preventing mis-mating is also provided. In one exemplary embodiment of the invention, the coaxial connector can comprise a body and a polarized shell within the body. The polarized shell can comprise an external wall, an internal wall, and two or more polarizing members circumferentially spaced apart on one of the external wall and the internal wall. A system for preventing mis-mating is also provided.

19 Claims, 8 Drawing Sheets

U.S. PATENT DOCUMENTS

| | | | | |
|---|---|---|---|---|
| 2008/0152460 | A1* | 6/2008 | Watanabe et al. | 411/412 |
| 2010/0025069 | A1 | 2/2010 | Smith, III et al. | |
| 2010/0027942 | A1 | 2/2010 | Smith, III et al. | |
| 2010/0029113 | A1 | 2/2010 | Smith, III et al. | |
| 2010/0130070 | A1 | 5/2010 | Isaac et al. | |
| 2010/0151717 | A1 | 6/2010 | Bulow | |
| 2010/0186989 | A1 | 7/2010 | Alvelo et al. | |

OTHER PUBLICATIONS

EMI Products Spring-Line™ BeCu Spring Fingers and Ground Strips copyright© 2001 accessed On-line at http://www.chomerics.com/products/fingerstock.htm on Aug. 12, 2010. (1 page).

MXL38999™ Optical Connectors accessed On-Line at http://www.molex.com/molex/products/family?key=mx1999&channel=products&chanName=family&pageTitle=Introduction on Aug. 12, 2010 (2 pages).

Intermark USA, Inc. Beryllium Copper Finger Gasket (BFG Series) accessed On-line at http://www.intermark-usa.com/products/EMC/Gaskets/BCFgasket.shtml on Aug. 12, 2010. (2 pages).

SV Microwave® ZMA accessed On-Line at http://www.svmicro.com/index.cfm?fuseaction=productoverview.one&content_id=42&x=48973 75 on Aug. 6, 2010 (1 page).

* cited by examiner

200

| | 110A | 110B | 110C | 110D |
|---|---|---|---|---|
| 200A | 315 | 225 | 135 | 45 |
| 200B | 270 | 230 | 140 | 90 |
| 200C | 305 | 260 | 100 | 55 |
| 200D | 335 | 270 | 180 | 25 |
| 200E | 330 | 245 | 170 | 30 |
| 200F | 325 | 190 | 90 | 35 |

FIG. 2

300

| | 110A | 110B | 110C | 110D |
|---|---|---|---|---|
| 300A | 45 | 135 | 225 | 315 |
| 300B | 90 | 140 | 230 | 270 |
| 300C | 55 | 100 | 260 | 305 |
| 300D | 25 | 180 | 270 | 335 |
| 300E | 30 | 170 | 245 | 330 |
| 300F | 35 | 90 | 190 | 325 |

FIG. 3

POLARIZED SHELL FOR PREVENTING COAXIAL CONNECTOR MIS-MATING

TECHNICAL FIELD

This invention relates generally to coaxial connectors, and more particularly, to a polarized shell for preventing mis-mating of coaxial connectors.

BACKGROUND

Coaxial connectors transmit radio signals at frequencies in the megahertz and gigahertz ranges. Many standard types of coaxial connectors have been created over the years, such as Type N, 7/16, SMA, TNC, and 2.92 mm. Type N coaxial connectors are durable, weatherproof, medium-sized connectors with consistent performance through 18 GHz. 7/16 coaxial connectors are used as replacements for Type N coaxial connectors in high power, low intermodulation applications, particularly in communications systems. SMA (Sub-Miniature version A) coaxial connectors are used in phase array radar, electronic test equipment, instrument landing systems, and other instrumentation using phase matching techniques. TNC coaxial connectors are threaded versions of BNC connectors, which are used for professional video connections, analog and serial digital interface signals, amateur radio antenna connections, aviation electronics, and electronic test equipment. 2.92 mm coaxial connectors are precision connectors for microwave applications up to 40 GHz.

A coaxial connector of a standard type can be a plug or a jack. A plug and a jack of the same standard type can be mated. Typically, a plug and the jack of the same type each comprise a thread, and the plug and the jack are threadably mated.

SUMMARY OF THE INVENTION

In one embodiment, a polarized shell for preventing mis-mating of a first coaxial connector comprising the polarized shell and a second coaxial connector is provided. The polarized shell comprises an external wall, an internal wall, and two or more polarizing members circumferentially spaced apart on one of the external wall and the internal wall.

In another embodiment, a coaxial connector for preventing mis-mating is provided. The coaxial connector comprises a body and a polarized shell within the body. The polarized shell comprises an external wall, an internal wall, and two or more polarizing members circumferentially spaced apart on one of the external wall and the internal wall.

In another embodiment, a system for preventing mis-mating is provided. The system comprises first and second coaxial connectors. Each of the first and second coaxial connectors comprises a body and a polarized shell disposed within the body. The polarized shell comprises an external wall, an internal wall, and two or more polarizing members circumferentially spaced apart on one of the external wall and the internal wall. The polarizing members of the polarized shell of the first coaxial connector are circumferentially spaced apart on one of the external wall of the polarized shell of the first coaxial connector and the internal wall of the polarized shell of the first coaxial connector in a plug spacing configuration. The polarizing members of the polarized shell of the second coaxial connector are circumferentially spaced apart on one of the external wall of the polarized shell of the second coaxial connector and the internal wall of the polarized shell of the second coaxial connector in a jack spacing configuration that mirrors the plug spacing configuration.

BRIEF DESCRIPTION OF THE DRAWINGS

A more particular description of the invention briefly summarized above may be had by reference to the embodiments, some of which are illustrated in the accompanying drawings. It is to be noted, however, that the appended drawings illustrate only typical embodiments of this invention and are therefore not to be considered limiting of its scope, for the invention may admit to other equally effective embodiments. Thus, for further understanding of the nature and objects of the invention, references can be made to the following detailed description, read in connection with the drawings in which:

FIG. 2 is a table depicting exemplary plug spacing configurations of polarizing members around a polarized shell disposed within a plug.

FIG. 3 is a table depicting exemplary jack spacing configurations of polarizing members around a polarized shell disposed within a jack.

DETAILED DESCRIPTION OF THE INVENTION

A coaxial cable of a standard type, such as Type N, 7/16, SMA, TNC, and 2.92 mm, can be a plug or a jack. Any plug and any jack of the same standard type can be mated. Typically, a plug and the jack of the same type each comprise a thread, and the plug and the jack are threadably mated. However, in applications where two plugs and two jacks of the same standard type are to be mated, the first plug may be mis-mated to the second jack, and the second plug may be mis-mated to the first jack. Such mis-mating can be prevalent where there are multiple plugs to mate with multiple and adjacent jacks, such as aircraft applications, where the plugs and jacks are located in difficult access positions.

Embodiments of the present invention provide for a system for preventing mis-mating. The system can comprise first and second coaxial connectors. Each of the first and second coaxial connectors can comprise a body and a polarized shell disposed within the body. The polarized shell can comprise an external wall, an internal wall, and two or more polarizing members circumferentially spaced apart on one of the external wall and the internal wall. The polarizing members of the polarized shell of the first coaxial connector can be circumferentially spaced apart on one of the external wall of the polarized shell of the first coaxial connector and the internal wall of the polarized shell of the first coaxial connector in a plug spacing configuration. The polarizing members of the polarized shell of the second coaxial connector can circumferentially spaced apart on one of the external wall of the polarized shell of the second coaxial connector and the internal wall of the polarized shell of the second coaxial connector in a jack spacing configuration that mirrors the plug spacing configuration.

Figure 1:
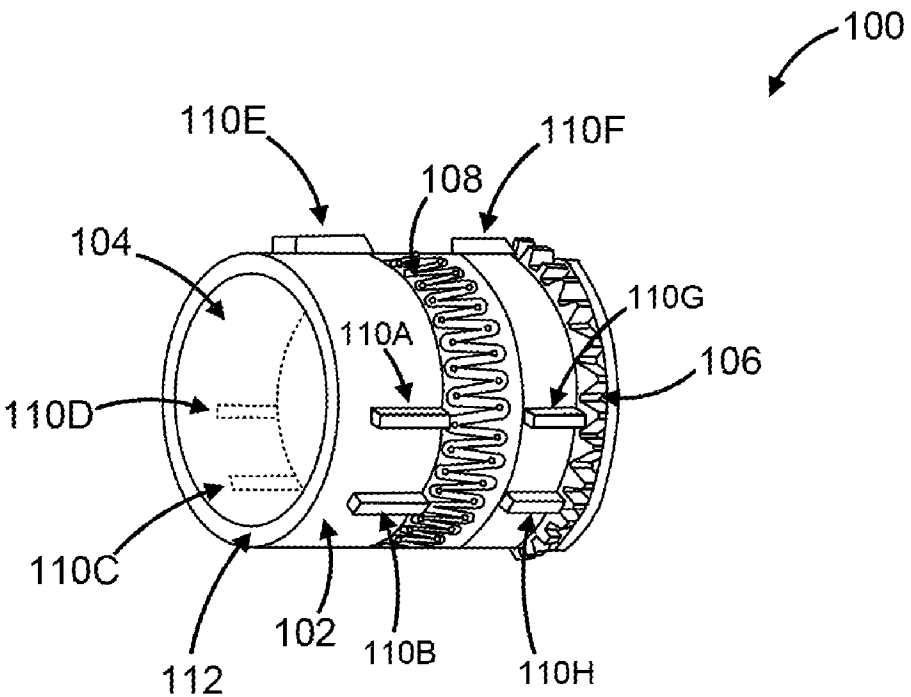
FIG. 1 is a perspective view of a polarized shell according to an exemplary embodiment of the invention.

FIG. 1 is a perspective view of a polarized shell 100 according to an exemplary embodiment of the invention. Polarized shell 100 can be disposed within a plug or a jack (not shown), and can comprise external wall 102, internal wall 104, ratchet wheel 106, spring finger gasket 108, two or more polarizing members 110A, 110B, 110C, 110D, 110E, 110F, 110G, and 110H, and front end 112. Ratchet wheel 106 and spring finger gasket 108 can be disposed around external wall 102. In one exemplary embodiment of the invention, spring finger gasket 108 can be made, at least in part, of beryllium copper for advantageously improving the effectiveness of shielding against the ingress of outside signals into a coaxial connector in which polarized shell 100 is disposed and the egress of signals intended to remain within the connector. Such ingress can result in noise and disruption of the desired signal, and such egress can result in electromagnetic interference (EMI) to outside devices.

While polarizing members 110A, 110B, 110C, 110D, 110E, 110F, 110G, and 110H are shown in FIG. 1 as keyways, polarizing members 110A, 110B, 110C, 110D, 110E, 110F, 110G, and 110H can be keyways, slots, or any combination of keyways and slots, as discussed herein with reference to FIGS. 4-7. In one exemplary embodiment of the invention, at least one of polarizing members 110A, 110B, 110C, 110D, 110E, 110F, 110G, and 110H is a keyway for advantageously preventing attempts to mis-mate a standard coaxial connector to a coaxial connector in which polarized shell 100 is disposed. Polarizing members 110A, 110B, 110C, 110D, 110E, 110F, 110G, and 110H can be circumferentially spaced apart on one of external wall 102 and internal wall 104. In one exemplary embodiment of the invention, at least two of polarizing members 110A, 110B, 110C, 110D, 110E, 110F, 110G, and 110H can be circumferentially spaced apart on one of external wall 102 and internal wall 104 in two or more rows. In one example of the embodiment, polarizing members 110A, 110B, 110C, 110D, and 110E can be circumferentially spaced apart on one of external wall 102 and internal wall 104 in a first row, and polarizing members 110F, 110G, and 110H can be circumferentially spaced apart on one of external wall 102 and internal wall 104 in a second row.

FIG. 2 is a table depicting exemplary plug spacing configurations 200 of polarizing members 110A, 110B, 110C, 110D, and 110E around polarized shell 100 as disposed within a plug (not shown). Each of plug spacing configurations 200 represents a number of degrees in an angle measured counterclockwise from polarizing member 110E and facing front end 112, the angle having as its vertex the center point of polarized shell 100. For example, in one exemplary embodiment of the invention, polarizing members 110A, 110B, 110C, 110D, and 110E can be circumferentially spaced apart on one of external wall 102 and internal wall 104 in plug spacing configuration 200A, e.g., polarizing member 110A can be three hundred fifteen degrees from polarizing member 110E, polarizing member 110B can be two hundred twenty-five degrees from polarizing member 110E, polarizing member 110C can be one hundred thirty-five degrees from polarizing member 110E, and polarizing member 110D can be forty-five degrees from polarizing member 110E. In other exemplary embodiments of the invention, polarizing members 110A, 110B, 110C, 110D, and 110E can be circumferentially spaced apart on one of external wall 102 and internal wall 104 in plug spacing configuration 200B, 200C, 200D, 200E, or 200F.

FIG. 3 is a table depicting exemplary jack spacing configurations 300 of polarizing members 110A, 110B, 110C, 110D, and 110E around polarized shell 100 as disposed within a jack (not shown). Each of jack spacing configurations 300 mirrors a corresponding plug spacing configuration 200 and represents a number of degrees in an angle measured counterclockwise from polarizing member 110E and facing front end 112, the angle having as its vertex the center point of polarized shell 100. For example, in one exemplary embodiment of the invention, polarizing members 110A, 110B, 110C, 110D, and 110E can be circumferentially spaced apart on one of external wall 102 and internal wall 104 in jack spacing configuration 300A, e.g., polarizing member 110A can be forty-five degrees from polarizing member 110E, polarizing member 110B can be one hundred thirty-five degrees from polarizing member 110E, polarizing member 110C can be two hundred twenty-five degrees from polarizing member 110E, and polarizing member 110D can be three hundred fifteen degrees from polarizing member 110E. In other exemplary embodiments of the invention, polarizing members 110A, 110B, 110C, 110D, and 110E can be circumferentially spaced apart on one of external wall 102 and internal wall 104 in jack spacing configuration 300B, 300C, 300D, 300E, or 300F.

Figure 4:
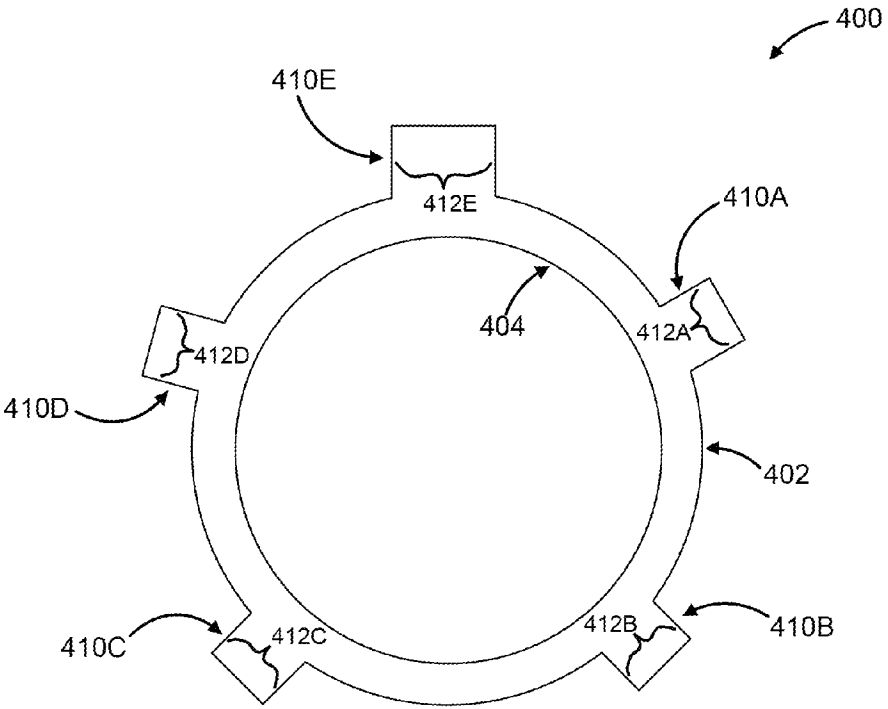
FIGS. 4-7 are front views of exemplary embodiments of a polarized shell.

FIG. 4 is a front view of another exemplary embodiment of a polarized shell 400. Like numerals are used to identify like components as between FIGS. 1 and 4, except that the numerals in FIG. 4 are increased by 300. By way of example, FIG. 4 illustrates that polarized shell 400 can comprise external wall 402, internal wall 404, and two or more polarizing members 410A, 410B, 410C, 410D, and 410E circumferentially spaced apart on external wall 402. In the exemplary embodiment shown in FIG. 4, each of polarizing members 410A, 410B, 410C, 410D, and 410E can be a keyway protruding from external wall 402. In one exemplary embodiment of the invention, a keyway can be a major keyway or a minor keyway. A major keyway can have a width that is greater than a width of a minor keyway. In one example of the embodiment, with reference to FIG. 4, polarizing member 410E can be a major keyway and can have width 412E of 0.09 inches, while polarizing members 410A, 410B, 410C, and 410D can be minor keyways and can have widths 412A, 412B, 412C, and 412D, respectively, of 0.032 inches.

Figure 5:
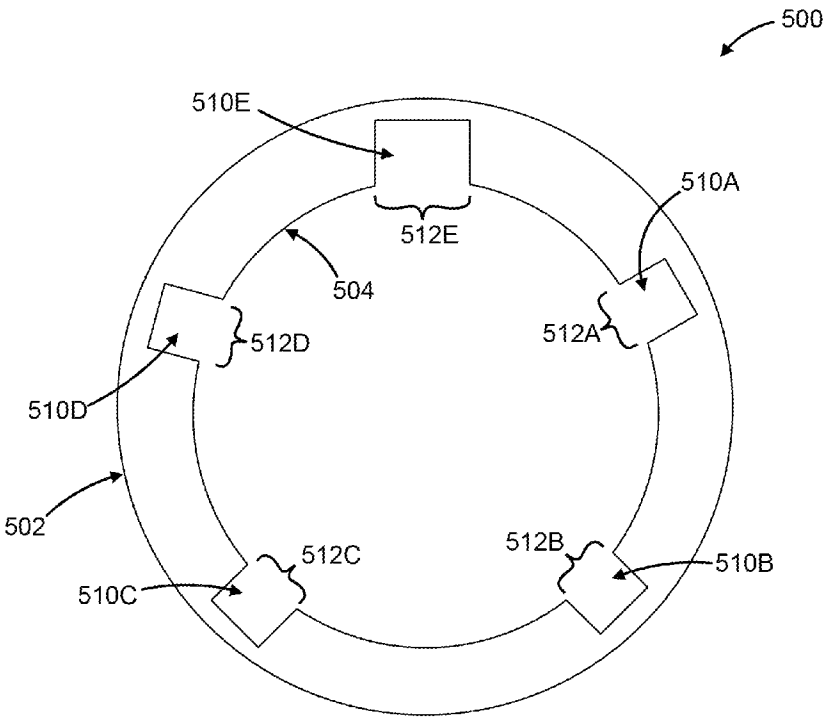

FIG. 5 is a front view of another exemplary embodiment of a polarized shell 500. Like numerals are used to identify like components as between the FIGS. 4 and 5, except that the numerals in FIG. 5 are increased by 100. By way of example, FIG. 5 illustrates that polarized shell 500 can comprise external wall 502, internal wall 504, and two or more polarizing members 510A, 510B, 510C, 510D, and 510E circumferentially spaced apart on internal wall 504. In the exemplary embodiment shown in FIG. 5, each of polarizing members 510A, 510B, 510C, 510D, and 510E can be a slot recessed into internal wall 504. In one exemplary embodiment of the invention, a slot can be a major slot or a minor slot. A major slot can have a width that is greater than a width of a minor slot. In one example of the embodiment, with reference to FIG. 5, polarizing member 510E can be a major slot and can have width 512E of 0.12 inches, while polarizing members 510A, 510B, 510C, and 510D can be minor slots having widths 512A, 512B, 512C, and 512D, respectively, of 0.06 inches.

Figure 6:
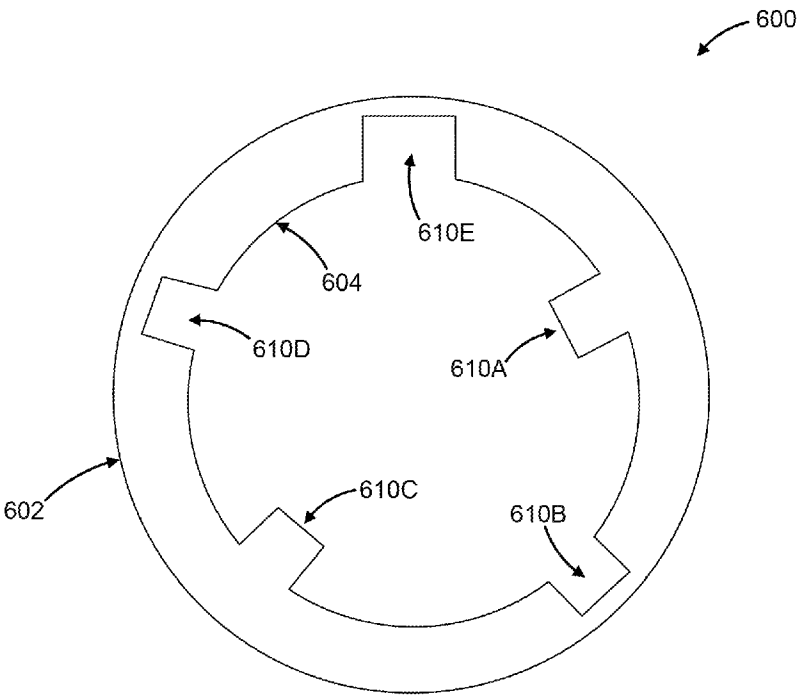

FIG. 6 is a front view of another exemplary embodiment of a polarized shell 600. Like numerals are used to identify like components as between the FIGS. 5 and 6, except that the numerals in FIG. 6 are increased by 100. By way of example, FIG. 6 illustrates that polarized shell 600 can comprise external wall 602, internal wall 604, and polarizing members 610A, 610B, 610C, 610D, and 610E circumferentially spaced apart on internal wall 604. In the exemplary embodiment shown in FIG. 6, polarizing members 610A and 610C are keyways protruding from internal wall 604, and polarizing members 610B, 610D, and 610E are slots recessed into internal wall 604.

Figure 7:
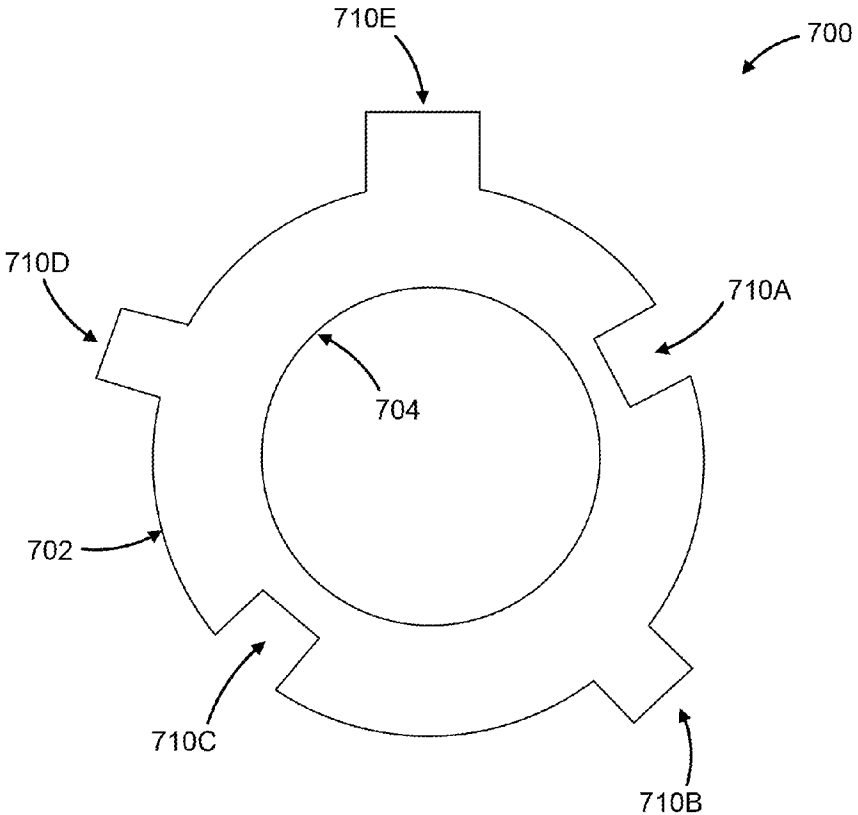

FIG. 7 is a front view of another exemplary embodiment of a polarized shell 700. Like numerals are used to identify like components as between the FIGS. 6 and 7, except that the numerals in FIG. 7 are increased by 100. By way of example, FIG. 7 illustrates that polarized shell 700 can comprise external wall 702, internal wall 704, and two or more polarizing members 710A, 710B, 710C, 710D, and 710E circumferentially spaced apart on external wall 702. In the exemplary embodiment shown in FIG. 7, polarizing members 710A and 710C are slots recessed into external wall 702, and polarizing members 710B, 710D, and 710E are keyways protruding from external wall 702.

Figure 8:
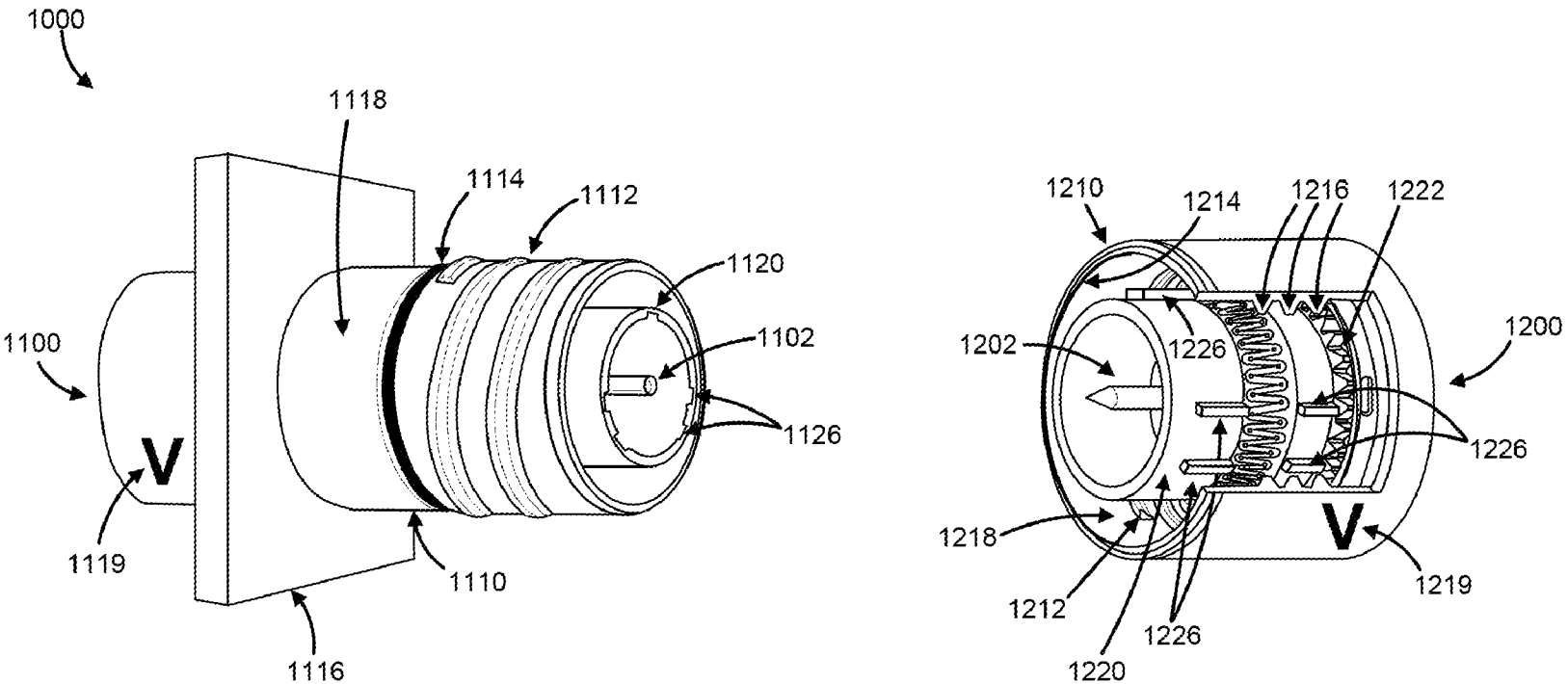
FIG. 8 is an illustration of a system for preventing mis-mating according to an exemplary embodiment of the invention.

FIG. 8 is an illustration of a system 1000 for preventing mis-mating according to an exemplary embodiment of the invention. System 1000 can comprise first coaxial connector 1100 and second coaxial connector 1200. While first coaxial connector 1100 and second coaxial connector 1200 are shown in FIG. 8 as Type N coaxial connectors, in other embodiments, first coaxial connector 1100 and second coaxial connector 1200 can be any type of coaxial connectors, e.g., Type N, 7/16, SMA, TNC, or 2.92 mm.

First connector 1100 can comprise pin socket 1102, body 1110, and polarized shell 1120. Pin socket 1102 can be disposed within polarized shell 1120 and can receive center pin 1202 of second connector 1200. In one exemplary embodiment of the invention, first connector 1100 can be devoid of pin socket 1102, and first connector 1100 can comprise a center pin disposed at least partially within polarized shell 1120. Body 1110 can comprise threaded end 1112, colored o-ring 1114, wall mount jack 1116, external wall 1118, and first connector marking code 1119. In one exemplary embodiment of the invention, threaded end 1112 can be a triple-start threaded end for advantageously facilitating the mating of first connector 1100 and second connector 1200. In another exemplary embodiment of the invention, threaded end 1112 can be a single-turn threaded end for advantageously facilitating the mating of first connector 1100 and second connector 1200. In another exemplary embodiment of the invention, threaded end 1112 can encircle a portion of external wall 1118.

Colored o-ring 1114 can be disposed around external wall 1118 and can be located between threaded end 1112 and wall mount jack 1116. Colored o-ring 1114 can be of any color, e.g., yellow, black, lime green, orange, blue, or purple, and can be made of a waterproof material, e.g., rubber. In one exemplary embodiment of the invention, colored o-ring 1114 can be adjacent to threaded end 1112. Colored o-ring 1114, when adjacent to threaded end 1112, can advantageously form a waterproof seal between external wall 1118 and internal wall 1218 of second connector 1200 when first connector 1100 and second connector 1200 are fully mated. In addition, colored o-ring 1114, when adjacent to threaded end 1112, can be covered by second connector 1200 when first connector 1100 and second connector 1200 are fully mated. The incomplete coverage of colored o-ring 1114 by second connector 1200 can advantageously serve as a warning that first connector 1100 and second connector 1200 are not fully mated and that, as a result, second connector 1200 may back off from first connector 1100 during use.

In one exemplary embodiment of the invention, the color of colored o-ring 1114 can be unique to one of jack spacing configurations 300. In one example of the embodiment, colored o-ring 1114 can be yellow for jack spacing configuration 300A. In another exemplary embodiment of the invention, the color of colored o-ring 1114 can be unique to one of plug spacing configurations 200. In one example of the embodiment, colored o-ring 1114 can be yellow for plug spacing configuration 200A.

Wall mount jack 1116 can be for mounting first connector 1100 to a wall of an electronic system. Polarized shell 1120 can be disposed within body 1110. While polarized shell 1120 is shown as polarized shell 500 discussed with reference to FIG. 5, in other embodiments, polarized shell 1120 can be any of polarized shells 100, 400, 500, 600, or 700 discussed with reference to FIG. 1 and FIGS. 4-7.

In one exemplary embodiment of the invention, first connector marking code 1119 can be unique to one of jack spacing configurations 300. In one example of the embodiment, first connector marking code 1119 can be "V" for jack spacing configuration 300A. In another exemplary embodiment of the invention, first connector marking code 1119 can be unique to one of plug spacing configurations 200. In one example of the embodiment, first connector marking code 1119 can be "V" for plug spacing configuration 200A.

Second connector 1200 can comprise center pin 1202, body 1210, and polarized shell 1220. Center pin 1202 can be disposed at least partially within polarized shell 1220 and can be for engaging pin socket 1102 of first connector 1100. In one exemplary embodiment of the invention, second connector 1200 can be devoid of center pin 1202, and second connector 1200 can comprise a pin socket disposed within polarized shell 1220.

Body 1210 can be used to rotatably mate first connector 1100 to second connector 1200. Body 1210 can comprise threaded end 1212, colored o-ring 1214, at least one pawl 1216, internal wall 1218, and second connector marking code 1219. In one exemplary embodiment of the invention, threaded end 1212 can encircle a portion of internal wall 1218. Threaded end 1212 can engage threaded end 1112 for rotatably mating second connector 1200 to first connector 1100. In one exemplary embodiment, second connector 1200 can be rotatably mated to first connector 1100 by engaging threaded end 1212 with threaded end 1112 and rotating body 1210.

Colored o-ring 1214 can be disposed around internal wall 1218. Colored o-ring 1214 can be of any color, e.g., yellow, black, lime green, orange, blue, or purple. In one exemplary embodiment of the invention, the color of colored o-ring 1214 can be unique to one of plug spacing configurations 200. In one example of the embodiment, colored o-ring 1114 can be yellow for plug spacing configuration 200A. In another exemplary embodiment of the invention, the color of colored o-ring 1214 can be unique to one of jack spacing configurations 300. In one example of the embodiment, colored o-ring 1114 can be yellow for jack spacing configuration 300A.

Pawl 1216 can protrude internally to body 1210 from internal wall 1218 and can be perpendicularly aligned with ratchet wheel 1222. Pawl 1216, when engaged with ratchet wheel 1222, advantageously restricts rotation of body 1210 in a direction whereby second connector 1200 can back off from first connector 1100, e.g., under conditions of severe vibration. Pawl 1216 can be slidably disengaged from ratchet wheel 1222. In one embodiment, pawl 1216 can be disengaged from ratchet wheel 1222 by retracting body 1210.

Polarized shell 1220 can be disposed within body 1210. While polarized shell 1220 is shown as polarized shell 100 discussed with reference to FIG. 1, in other embodiments, polarized shell 1220 can be any of polarized shells 100, 400, 500, 600, or 700 discussed with reference to FIG. 1 and FIGS. 4-7.

In one exemplary embodiment of the invention, second connector marking code 1219 can be unique to one of jack spacing configurations 300. In one example of the embodiment, second connector marking code 1219 can be "V" for jack spacing configuration 300A. In another exemplary embodiment of the invention, second connector marking code 1219 can be unique to one of plug spacing configurations 200. In one example of the embodiment, second connector marking code 1219 can be "V" for plug spacing configuration 200A.

While the present invention has been described with reference to a particular preferred embodiment and the accompanying drawings, it will be understood by those skilled in the art that the invention is not limited to the preferred embodiment and that various modifications and the like could be made thereto without departing from the scope of the invention as defined in the following claims.

What is claimed is:

1. A polarized shell for preventing mis-mating of a first coaxial connector comprising the polarized shell and a second coaxial connector, the first and second coaxial connector for transmitting radio signals at frequencies in the megahertz and gigahertz range, the polarized shell comprising:

an external wall;

a ratchet wheel disposed around the external wall adapted to restrict rotation of a body coupled to the polarized shell;

a spring finger gasket disposed around the external wall for shielding against the egress of the radio signals in the megahertz and gigahertz range;

an internal wall; and two or more polarizing members circumferentially spaced apart on one of the external wall and the internal wall.

2. The polarized shell of claim 1, wherein the polarizing members include one or more keyways protruding from the external wall.

3. The polarized shell of claim 1, wherein the polarizing members include one or more slots recessed into the external wall.

4. The polarized shell of claim 1, wherein the polarizing members include one or more keyways protruding from the internal wall.

5. The polarized shell of claim 1, wherein the polarizing members include one or more slots recessed into the internal wall.

6. The polarized shell of claim 1, wherein the polarizing members include first and second keyways protruding from one of the internal wall and the external wall, wherein a width of the first keyway is greater than a width of the second keyway.

7. The polarized shell of claim 1, wherein the polarizing members include first and second slots recessed into one of the external wall and the internal wall, wherein a width of the first slot is greater than a width of the second slot.

8. The polarized shell of claim 1, wherein the polarizing members include first and second polarizing members circumferentially spaced apart in two rows.

9. A coaxial connector for preventing mis-mating, the coaxial connector for transmitting radio signals at frequencies in the megahertz and gigahertz range, the coaxial connector comprising:

a body comprising an internal wall and a single-turn threaded end;

a polarized shell disposed within the body, the polarized shell comprising:

an external wall;

a ratchet wheel disposed around the external wall;

an internal wall; and two or more polarizing members circumferentially spaced apart on one of the external wall and the internal wall; and a pawl protruding from the internal wall of the body, the pawl coupled to the ratchet wheel and adapted to prevent rotation of the body relative to the polarized shell.

10. The coaxial connector of claim 9, further comprising a colored o-ring.

11. The coaxial connector of claim 10, wherein the body further comprises an external wall, the single-turn threaded end encircling a portion of the external wall, and wherein the colored o-ring is adjacent to the threaded end.

12. The coaxial connector of claim 10, wherein the polarizing members are circumferentially spaced apart on one of the external wall and the internal wall in a spacing configuration, and wherein a color of the colored o-ring is unique to the spacing configuration.

13. The coaxial connector of claim 9, wherein the body further comprises a wall mount jack.

14. The coaxial connector of claim 9, further comprising a marking code.

15. The coaxial connector of claim 14, wherein the polarizing members are circumferentially spaced apart on one of the external wall and the internal wall in a spacing configuration, and wherein the marking code is unique to the spacing configuration.

16. A system for preventing mis-mating, the system comprising:

first and second coaxial connectors for transmitting radio signals at frequencies in the megahertz and gigahertz range, each of the first and second coaxial connectors comprising:

a body;

a polarized shell disposed within the body, the polarized shell comprising:

an external wall;

an internal wall; and two or more polarizing members circumferentially spaced apart on one of the external wall and the internal wall;

wherein the polarizing members of the polarized shell of the first coaxial connector are circumferentially spaced apart on one of the external wall of the polarized shell of the first coaxial connector and the internal wall of the polarized shell of the first coaxial connector in a plug spacing configuration;

wherein the polarizing members of the polarized shell of the second coaxial connector are circumferentially spaced apart on one of the external wall of the polarized shell of the second coaxial connector and the internal wall of the polarized shell of the second coaxial connector in a jack spacing configuration that mirrors the plug spacing configuration wherein the first and second coaxial connectors each further comprises a colored o-ring, and wherein a color of the colored o-ring of the first coaxial connector matches a color of the colored o-ring of the second coaxial connector; and wherein the o-ring of the first coaxial connector is covered by the second coaxial connector when the first coaxial connector and the second coaxial connector are fully mated.

17. The system of claim 16, wherein the first and second coaxial connectors each further comprises a marking code, and the marking code of the first coaxial connector matches the marking code of the second coaxial connector.

18. The polarized shell of claim 1, wherein the polarizing members include one or more keyways protruding from the external wall, and one or more slots recessed into the external wall.

19. The polarized shell of claim 1, wherein the polarizing members include one or more keyways protruding from the internal wall, and one or more slots recessed into the internal wall.

* * * * *